US006371297B1

(12) United States Patent
Cha

(10) Patent No.: US 6,371,297 B1
(45) Date of Patent: Apr. 16, 2002

(54) MEDICATION DOSAGE REGULATION APPARATUS

(76) Inventor: Young Dae Cha, 1809 TufaTer., Silver Spring, MD (US) 20904

( * ) Notice: Subject to any disclaimer, the term of this patent is extended or adjusted under 35 U.S.C. 154(b) by 0 days.

(21) Appl. No.: 09/615,789

(22) Filed: Jul. 13, 2000

Related U.S. Application Data

(60) Provisional application No. 60/143,681, filed on Jul. 14, 1999.

(51) Int. Cl.[7] ..... B65D 83/04
(52) U.S. Cl. ..... 206/534; 206/538; 206/466
(58) Field of Search ..... 206/528–539, 206/466, 459.1, 561, 438

(56) References Cited

U.S. PATENT DOCUMENTS 3,207,421 A * 9/1965 Hunger et al. ..... 206/534
3,324,995 A * 6/1967 Sharp, Jr. ..... 206/534
3,381,808 A * 5/1968 McGraw II ..... 206/534
4,318,477 A * 3/1982 Kerpe ..... 206/534
4,817,819 A * 4/1989 Kelly ..... 206/534
4,972,657 A * 11/1990 McKee ..... 206/534
5,174,451 A * 12/1992 Niven ..... 206/534
5,242,055 A * 9/1993 Pora ..... 206/532
5,511,665 A * 4/1996 Dressel et al. ..... 206/523
5,669,503 A * 9/1997 Robin ..... 206/528
5,788,079 A * 8/1998 Bouthiette ..... 206/534
5,788,974 A * 8/1998 D'Amico et al. ..... 206/534
5,833,072 A * 11/1998 Lmbelet, Jr. ..... 206/534

* cited by examiner

*Primary Examiner*—Mickey Yu
*Assistant Examiner*—Jila M. Mohandesi
(74) *Attorney, Agent, or Firm*—Rosenberg, Klein & Lee

(57) ABSTRACT

A medication dosage regulation apparatus is provided for guiding the safe and reliable administration of medication in accordance with the prescribed procedure. The apparatus generally comprises a patient's medication holder and a removable cover substantially enveloping that medication holder. The medication holder includes a plurality of compartments for respectively storing a plurality of medication doses to be administered in compliance with the prescribed procedure. The medication holder for the corresponding time and auxiliary indicia for guiding the user. The cover is marked with identification indicia pertaining to the intended recipient of the medication doses. In certain embodiments, the apparatus also comprises at least one overlay removably attached to the medication holder for bearing at least a portion of the time and auxiliary indicia.

21 Claims, 4 Drawing Sheets

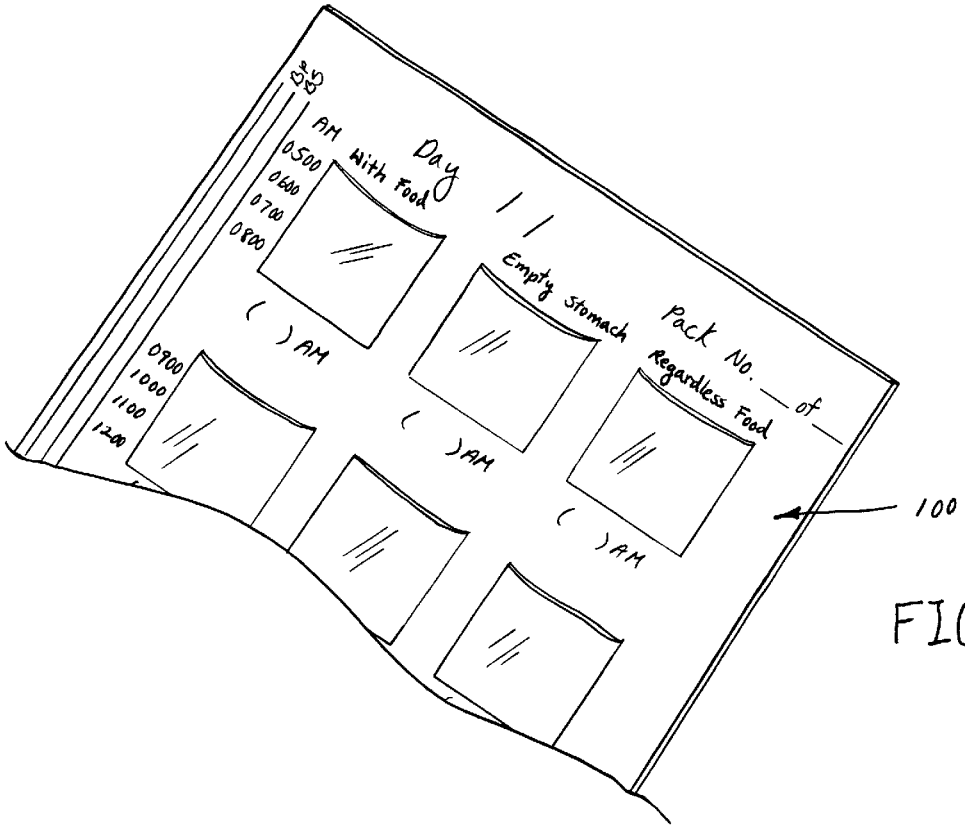
FIG. 2
FIG. 3
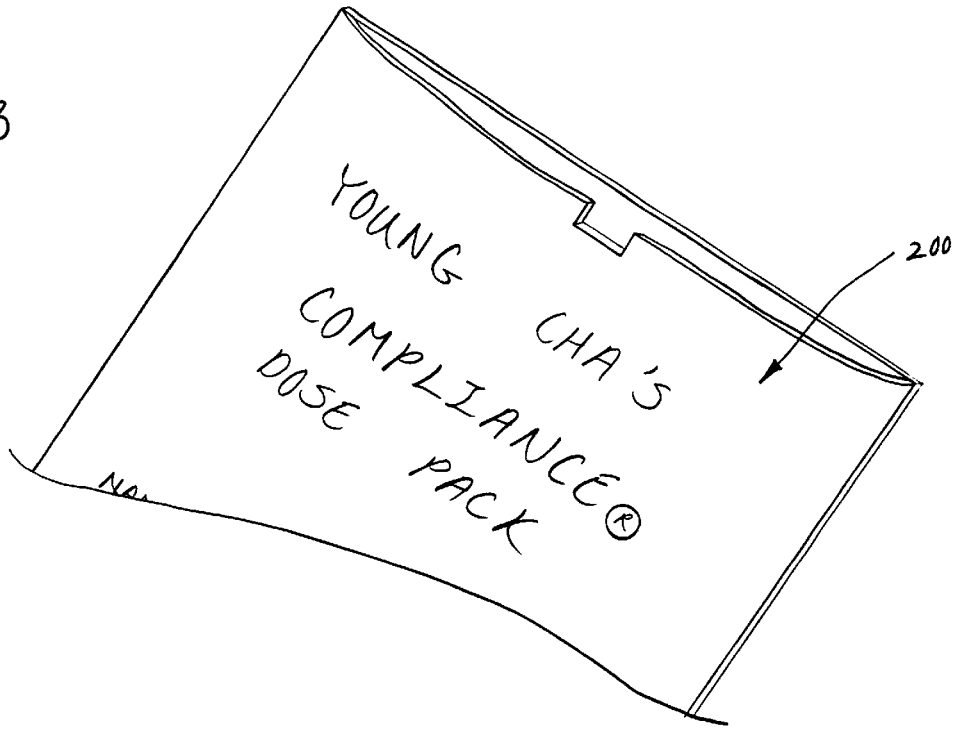

MEDICATION DOSAGE REGULATION APPARATUS

RELATED U.S. APPLICATION DATA

This Patent Application is based upon U.S. Provisional Patent Application, Serial No. 60/143,681, filed Jul. 14, 1999.

BACKGROUND OF THE INVENTION

1. Field of the Invention

The present invention is generally directed to a device for providing reliable prescription drug dosage reminders. The subject dose pack apparatus provides a visual reminder to patients as to when medication is to be taken. More specifically, the subject dose pack indicates both when and how to take the given medication—with food, on an empty stomach, or without regard to the ingestion of food, for instance.

Because close compliance with time and dosage schedules in taking prescription drugs is quite crucial to a patient's treatment, the subject dose pack provides an important function. This is particularly so in the case of multi-drug therapy—especially with elderly patients wherein both the time and manner in which particular medication doses are to be taken may vary significantly for different drugs.

2. Prior Art

Medication carrying cases and dial pack dispensers are known in the art. The best prior art known to Applicant includes U.S. Pat. Nos. 4,693,371; 5,558,229; 5,954,225; 3,126,129; 4,148,273; and, 4,223,801. Devices disclosed in such prior art, however, fail to yield the combination of features provided by the subject compliance dose pack apparatus sufficient to very simply, yet effectively, make available medication doses to a patient in accordance with even highly regimented time and dosage schedules. The devices of the prior art, therefore, fail to provide sufficient means for reliably guiding patients through the safe administration of multi-dose medications.

These are important concerns, as food-drug and drug-drug interactions are critical factors in drug treatment. A compliance dose pack formed in accordance with this invention serves to safely guide a patient undergoing even multi-drug therapy to avoid the dangerous consequences of such interactions by enabling the patient to adhere closely to the counseling and direction offered by the dispensing pharmacist or other health care professional.

SUMMARY OF THE INVENTION

A primary object of the present invention is, therefore, to provide a dosage regulation apparatus that enables a patient to closely adhere to a health care professional's directives, and thereby safely use prescribed medication doses.

It is another object of the present invention to provide an apparatus for guiding the reliable administration of medication in accordance with a prescribed time and dosage schedule.

These and other objects are attained in a compliance dose pack apparatus formed in accordance with the present invention. The subject compliance dose pack apparatus generally comprises a medication holder and a removable cover substantially enveloping that medication holder. The medication holder includes a plurality of compartments for respectively storing a plurality of medication doses to be administered in time displaced manner. The medication holder further includes for each compartment corresponding time indicia which delineates a predetermined administration time for the medication dose contained in the given compartment and corresponding auxiliary indicia which delineates predetermined information pertinent to the administration of that medication dose. The cover is marked with identification indicia pertaining to the intended recipient of the medication doses.

In one embodiment of the dose pack apparatus, the apparatus further comprises at least one overlay removably attached to the medication holder for bearing at least a portion of the time and auxiliary indicia. The overlay is preferably formed with a plurality of cutouts for maintaining open access to the compartments therethrough. Also in one embodiment of the compliance dose pack, at least one compartment of the medication holder is defined at least in part by a pouch.

DESCRIPTION OF THE DRAWINGS

FIG. 2 is a more detailed perspective view, partially cut-away, of a first portion of the embodiment of the present invention shown in FIG. 1;

FIG. 3 is a more detailed perspective view, partially cut-away, of a second portion of the embodiment of the present invention shown in FIG. 1;

DETAILED DESCRIPTION OF THE PREFERRED EMBODIMENTS

Figure 1:
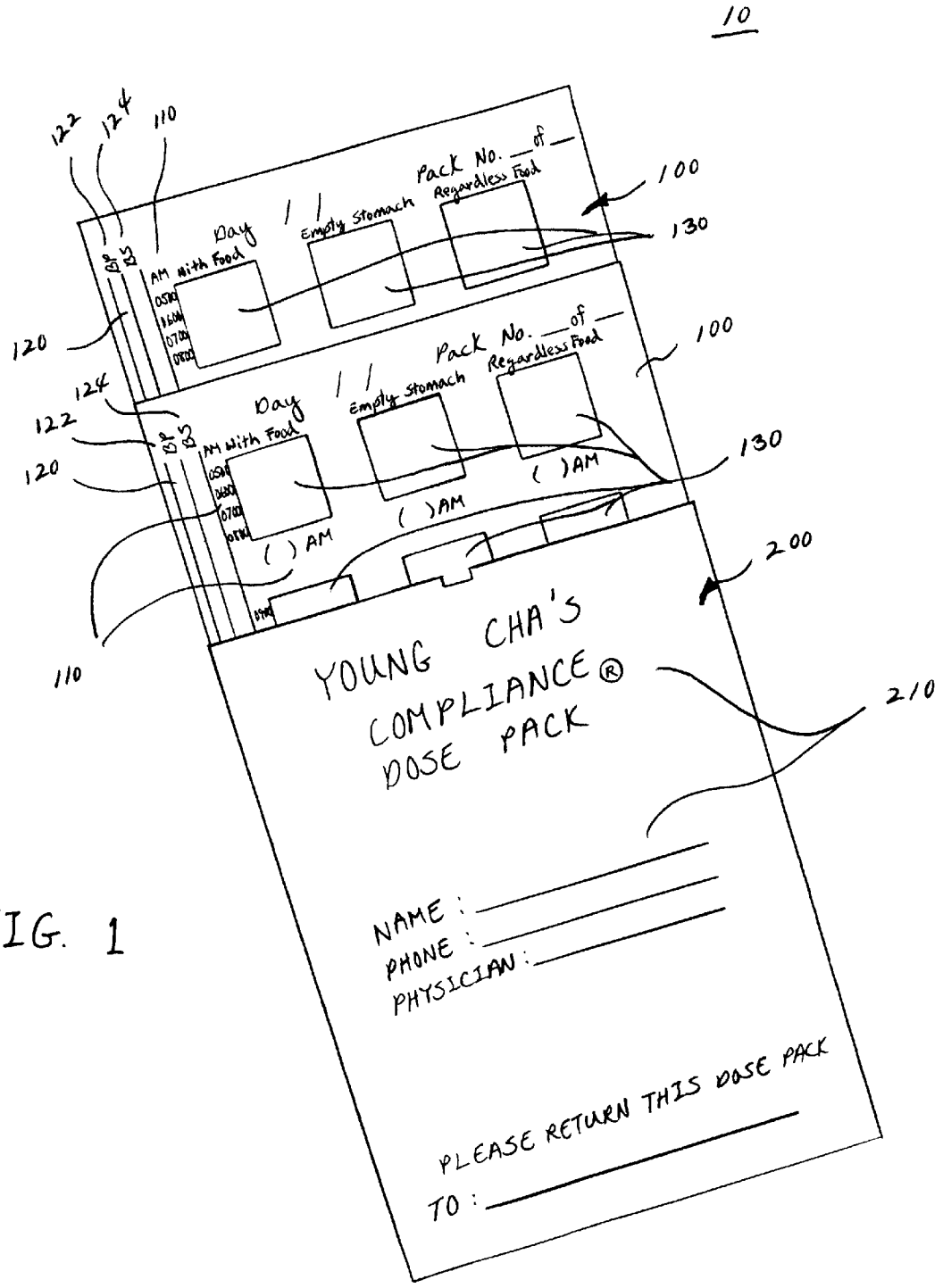
FIG. 1 is an illustrative view of one embodiment of the present invention.

Referring now to FIGS. 1–3, there is shown one embodiment of a compliance dose pack 10 formed in accordance with the present invention. The compliance dose pack 10 generally includes two parts. The first part is a medication holder 100 for holding pills or other forms of medication. The second part is a cover 200 for covering the medication holder 100. The medication holder 100 includes a time indicator 110 and spaces (or fields) 120 for the recordation of blood test results, such as blood sugar and blood pressure indications 122, 124.

The dose pack in the embodiment shown is formed with a plurality of arrayed holding compartment columns (preferably, three). Each holding compartment 130 holds a particular dose of medication, and may be formed by holding pouches as shown, or by alternative/supplemental use of other structural configurations such as recesses or depressions 130' (shown in the alternate embodiment of the medication holder 100' in FIG. 5) and the like. One column of compartments 130 in the embodiment shown is preferably marked with the heading "With Food" to indicate that the medication doses contained in the compartments 130 of that column are to be ingested concurrently with food. Another column of compartments 130 is preferably marked with the heading "Empty Stomach" to indicate that the medication doses contained in the compartments 130 of that column are to be ingested without food, and without having recently ingested any other food. A third column of compartments 130 is preferably marked with the heading "Regardless Food" to indicate that the medication doses contained in the compartments 130 of this column may be ingested without regard for food recently or presently ingested by the patient.

A time indicator space 112 is provided beneath each compartment 130. The appropriate time at which the medication dose in a given compartment 130 is to be taken may be recorded in such time indicator space 112.

Figure 4:
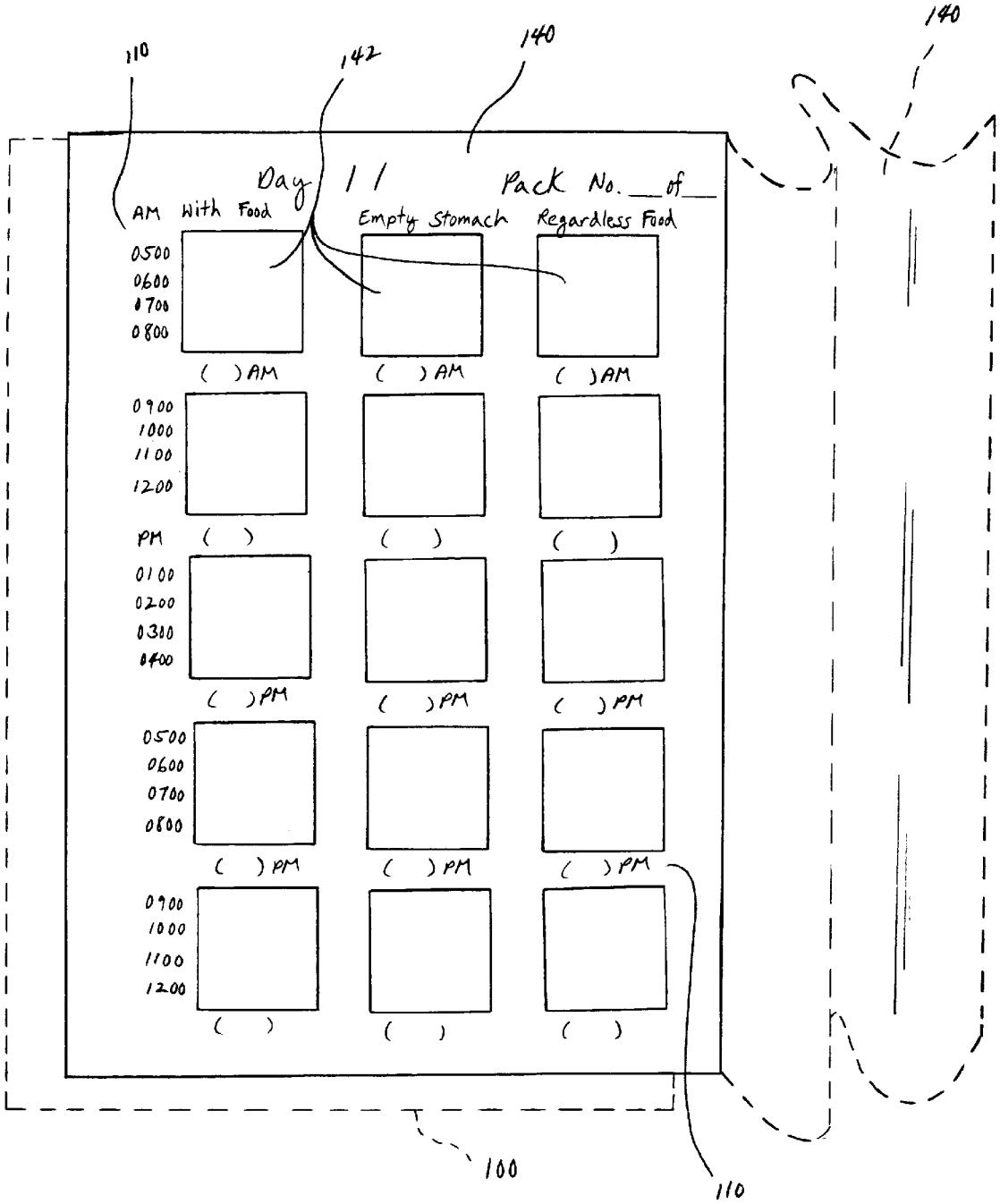
FIG. 4 is an illustrative view of a third portion that may be incorporated into the embodiment of the present invention of FIG. 1.

Referring to FIG. 4, a paper overlay 140 having cutout portions 142 which substantially correspond in contour to the pouches or depressions defining the compartments 130, 130' may be removably attached to the medication holder 100. The paper overlay 140 may have printed thereon the information relating to the column headings, times, and/or blood test results (not shown). Information may also be written on the overlay—for convenient later removal 20 rather than on the underlying base surface of the medication holder 100. A plurality of such overlays may be provided in removably attached manner to the medication holder 100.

The compliance dose pack 10 thus aids a multi-drug user to easily and conveniently comply with the proper drug-taking regimen directed by a dispensing pharmacist or other healthcare professional. A separate compliance dose pack 10 filled with the required medication doses may be provided for each calendar day of medication therapy, and a plurality of such filled compliance dose packs 10 may be dispensed to cover multiple days of therapy. For instance, 7 filled dose packs may be dispensed for a one week therapy period; 10 filled dose packs may be dispensed for a ten day therapy period; and, 20–30 filled dose packs may be dispensed for 20–30 day therapy periods.

Alternatively, a plurality of medication holders 100 filled with the required medication doses may be provided in a single compliance dose pack 10, as illustrated in FIG. 1. Each medication holder 100 would then correspond to each separate calendar day of the therapy period.

The cover 200 preferably has formed thereon identification indicia 210 pertaining to the patient for whom the medication doses contained in the compliance dose pack are intended. Other necessary or desired indicia may also be similarly formed.

The compliance dose pack 10 is preferably made of a plastic material, with the cover 200 provided preferably in the form of a sleeve which fits over the medication holder 100. One or both of the medication holder 100 and cover 200 may alternatively be formed of heavy paper, cardboard, or any other such materials suitable for the specific requirements of the intended application.

Figure 5:
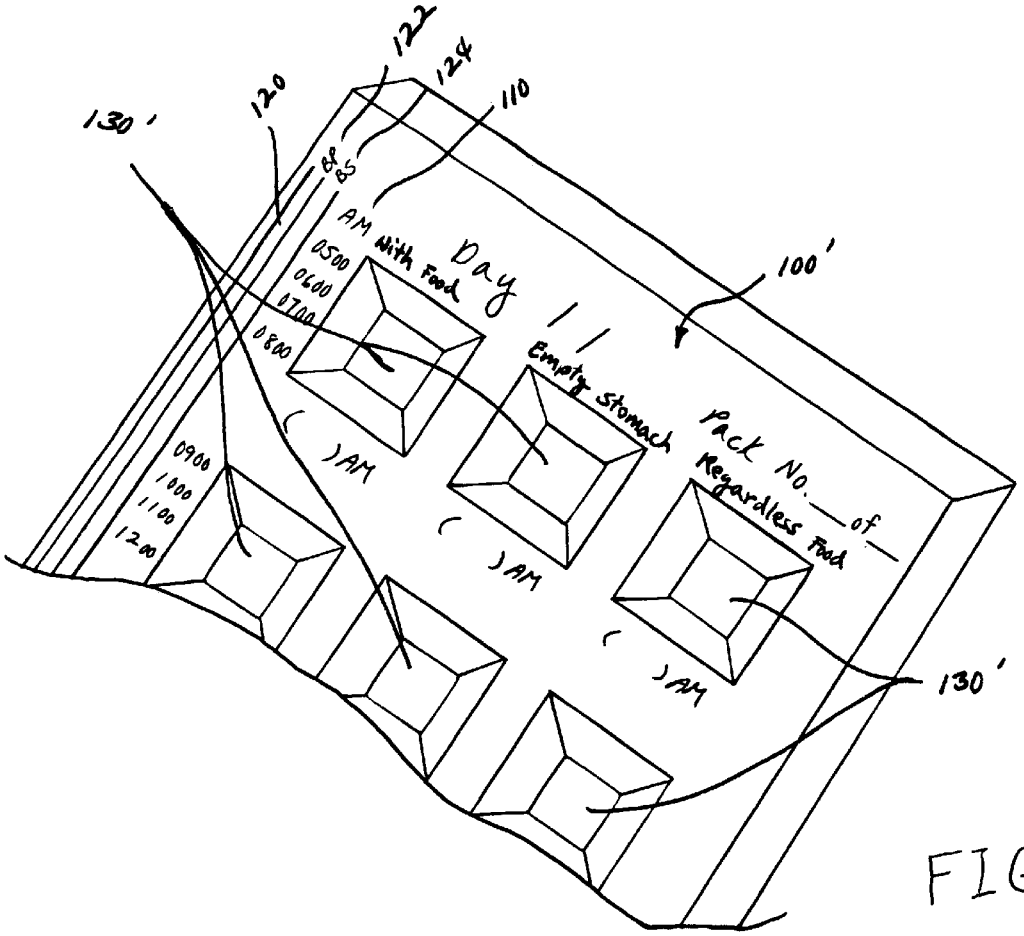
FIG. 5 is a perspective view, partially cut-away, of an alternate embodiment of the first portion shown in FIG. 2; and, FIG. 6 is a perspective view, partially cut-away, of an alternate embodiment of the second portion shown in FIG. 2.
Figure 6:
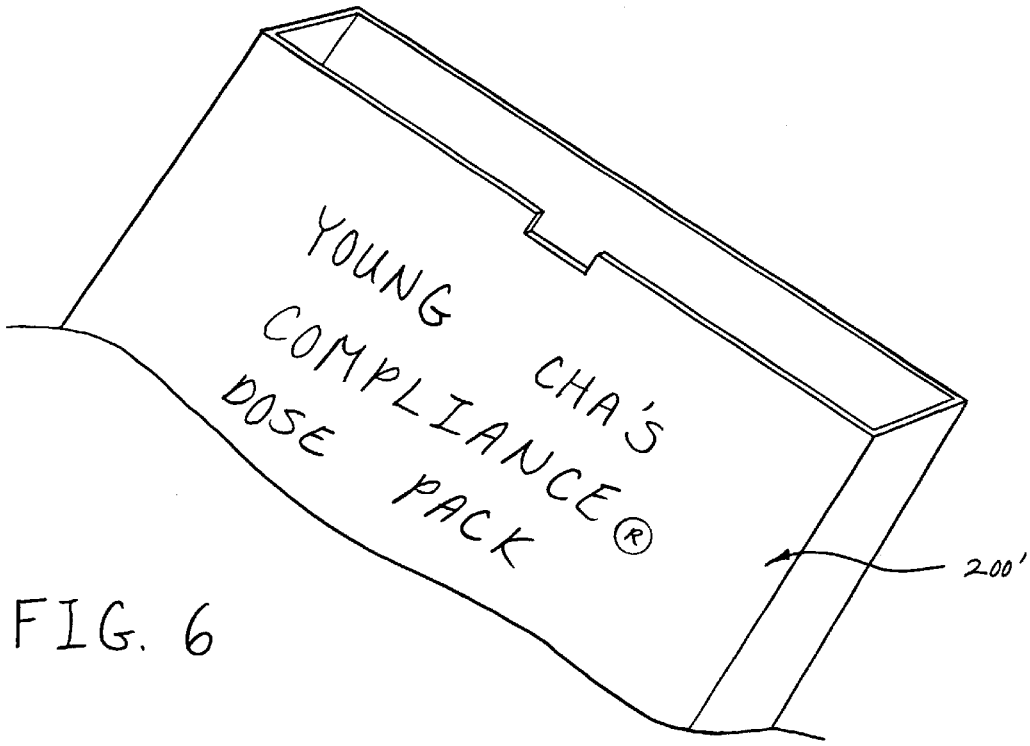

In the embodiment shown in FIGS. 5–6, the medication holder 100' of the compliance dose pack 10 is preferably dimensioned approximately between 15 to 26.5 cm in length, 10 to 20 cm in width, and 1 to 2 cm in depth. Each compartment 130' of the medication holder 100' is preferably formed in the embodiment dimensioned approximately 1.5 to 3.5 cm in length, 2.5 to 4 cm in width, and 1 to 2 cm in depth. The cover 200' is dimensioned accordingly to receive at least one medication holder 100' therein.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, the number and arrangement of elements may be varied, and certain features may be used independently of other features, all without departing from the spirit or scope of the invention as defined in the appended Claims.

What is claimed is:

1. A compliance dose pack apparatus for refillably containing and guiding the coordinated administration of multiple medications in accordance with respective predetermined time and dosage schedules therefor comprising:

(a) a medication holder having at least first and second sets of a plurality of openly accessible compartments for respectively storing a plurality of medication doses to be administered in time displaced and ingestion direction indicative manner, said first set of compartments refillably containing doses of a first medication type, said second set of compartments refillably containing doses of a second medication type, said medication holder including for each said compartment corresponding time indicia for delineating a predetermined administration time for the medication dose contained therein, said medication holder further including for each said compartment corresponding auxiliary indicia for delineating predetermined ingestion directive information pertaining to the medication dose contained therein, said medication holder having extending adjacent a peripheral portion thereof clinical indicia pertaining to an intended recipient transversely oriented relative to at least one of said time and auxiliary indicia; and, (b) a cover detachably receiving to substantially envelop said medication holder and thereby removably block access to said compartments, said cover being marked with identification indicia pertaining to the intended recipient of the medication doses.

2. The compliance dose pack apparatus as recited in claim 1 further comprising at least one overlay removably attached to said medication holder for bearing at least a portion of said time and auxiliary indicia, said overlay having formed therein a plurality of cutouts for maintaining open access to said compartments therethrough.

3. The compliance dose pack apparatus as recited in claim 1 wherein at least one said compartment of said medication holder is defined at least in part by a pouch.

4. The compliance dose pack apparatus as recited in claim 1 wherein said medication holder includes a base surface, and at least one said compartment is defined at least in part by a recess formed into said base surface.

5. The compliance dose pack apparatus as recited in claim 1 wherein said auxiliary indicia of said medication holder includes marks alerting a user to administer the medication dose with food; without food on an empty stomach; or, without regard to the ingestion of food.

6. The compliance dose pack apparatus as recited in claim 5 wherein said compartments of said medication holder are arranged in an array having a plurality of rows and columns.

7. The compliance dose pack apparatus as recited in claim 6 wherein each said alerting mark of said auxiliary indicia of said medication holder is disposed adjacent a distinct column of said compartments.

8. The compliance dose pack apparatus as recited in claim 7 wherein one said time indicia is disposed adjacent each said compartment of said medication holder.

9. The compliance dose pack apparatus as recited in claim 1 wherein said clinical indicia includes marks denoting blood test results for the intended recipient.

10. The compliance dose pack apparatus as recited in claim 1 comprising a plurality of said medication holders, each said medication holder corresponding to a distinct calendar day.

11. The compliance dose pack apparatus as recited in claim 1 wherein said cover includes a flexible sleeve member.

12. A compliance dose pack apparatus for refillably containing and guiding the coordinated administration of multiple medications in accordance with respective predetermined time and dosage schedules therefor comprising:

(a) a medication holder having an array of openly accessible compartments for respectively storing a plurality of medication doses to be administered in time displaced and ingestion direction indicative manner, said array defining a first set of said compartments refillably containing doses or a first medication type and a second set of said compartments refillably containing doses of a second medication type, said medication holder including for each said compartment corresponding time indicia for delineating a predetermined administration time for the medication dose contained therein, said medication holder further including for each said compartment corresponding auxiliary indicia for delineating predetermined ingestion directive information pertaining to the medication dose contained therein, said auxiliary indicia including marks alerting a user of a prescribed mode of administration, each said alerting mark being disposed adjacent a distinct column of said compartments, said medication holder having extending adjacent a peripheral portion thereof clinical indicia pertaining to an intended recipient transversely oriented relative to at least one of said time and auxiliary indicia; and, (b) a cover detachably receiving to substantially envelop said medication holder and thereby removably block access to said compartments, said cover being marked with identification indicia pertaining to the intended recipient of the medication doses.

13. The compliance dose pack apparatus as recited in claim 12 wherein said modes of administration alerted by said alerting marks include administering the medication dose with food; administering the medication dose without food on an empty stomach; and, administering the medication dose without regard to the ingestion of food.

14. The compliance dose pack apparatus as recited in claim 12 wherein said clinical indicia includes marks denoting blood test results for the intended recipient.

15. The compliance dose pack apparatus as recited in claim 12 wherein at least one said compartment of said medication holder is defined at least in part by a pouch.

16. The compliance dose pack apparatus as recited in claim 12 wherein said medication holder includes a base surface, and at least one said compartment is defined at least in part by a recess formed into said base surface.

17. The compliance dose pack apparatus as recited in claim 12 further comprising at least one overlay removably attached to said medication holder for bearing at least a portion of said time and auxiliary indicia, said overlay having formed therein a plurality of cutouts for maintaining open access to said compartments therethrough.

18. A compliance dose pack apparatus for refillable containing and guiding a user to reliably administer a plurality of doses of multiple medication types in accordance with respective predetermined time and dosage schedules therefor comprising:

(a) a medication holder including:

(1) a base surface;

(2) an array of openly accessible compartments formed on said base surface for respectively storing a plurality of medication doses to be administered in time displaced and ingestion direction indicative manner, said array of compartments defining a first set of said compartments refillably containing doses of a first medication type and a second set of said compartments refillably containing doses of a second medication type; and (3) at least one overlay removably attached to said base surface, said overlay having formed thereon for each said compartment corresponding time indicia for delineating a predetermined administration time for the medication dose contained therein, said overlay further having formed thereon for each said compartment corresponding auxiliary indicia for delineating predetermined ingestion directive information pertaining to the medication dose contained therein, said auxiliary indicia including marks respectively disposed adjacent distinct columns of said compartments for alerting a user of prescribed modes of administration including: administering the medication dose with food, administering the medication dose without food on an empty stomach, and administering the medication dose without regard to the ingestion of food, said overlay having extending adjacent a peripheral portion thereof clinical indicia pertaining to an intended recipient transversely oriented relative to at least one of said time and auxiliary indicia; and, (b) a cover detachably receiving to substantially envelop said medication holder, said cover being marked with identification indicia pertaining to an intended recipient of the medication doses.

19. The compliance dose pack apparatus as recited in claim 18 wherein at least one said compartment of said medication holder is defined at least in part by a pouch.

20. The compliance dose pack apparatus as recited in claim 18 wherein said clinical indicia includes marks denoting blood test results for the intended recipient.

21. A method of guiding in coordinated manner the administration of multiple medications in accordance with respective predetermined time and dosage schedules therefor comprising the steps of:

(a) establishing a medication holder having a plurality of openly accessible and refillable compartments for respectively storing a plurality of medication doses to be administered in time displaced and ingestion direction indicative manner, (b) defining a first set of said compartments refillably containing doses of a first medication type and a second set of said compartments refillably containing doses of a second medication type;

(c) forming for each said compartment corresponding time indicia delineating a predetermined administration time for the medication dose contained therein;

(d) forming for each said compartment corresponding auxiliary indicia delineating predetermined ingestion directive information pertaining to the medication dose contained therein;

(e) forming to extend adjacent a peripheral portion of said medication holder clinical indicia pertaining to an intended recipient transversely oriented relative to at least one of said time and auxiliary indicia (f) establishing a cover detachably receiving to substantially envelop said medication holder and thereby removably block access to said compartments, said cover being marked with identification indicia pertaining to the intended recipient of the medication doses, said cover being selectively displaceable relative to said medication holder to permit open access to at least a portion of said compartments for retrieval by the intended recipient of a selected one of the medication doses.

* * * * *